US005254070A

United States Patent [19]

Callhoff

[11] Patent Number: 5,254,070

[45] Date of Patent: Oct. 19, 1993

[54] GODET

[75] Inventor: Ernst Callhoff, Remscheid, Fed. Rep. of Germany

[73] Assignee: Barmag AG, Remscheid, Fed. Rep. of Germany

[21] Appl. No.: 841,579

[22] Filed: Feb. 26, 1992

[30] Foreign Application Priority Data

Feb. 26, 1991 [DE] Fed. Rep. of Germany ..... 4105968
Mar. 11, 1991 [DE] Fed. Rep. of Germany ..... 4107719

[51] Int. Cl.[5] ..... B21B 13/02

[52] U.S. Cl. ..... 492/16; 492/46; 219/10.492; 219/10.61 A

[58] Field of Search ..... 29/110, 116.1, 123; 219/10.492, 10.61 A, 469; 226/190, 191, 194; 492/7, 16, 46

[56] References Cited

U.S. PATENT DOCUMENTS

| | | | |
|---|---|---|---|
| 3,221,389 | 12/1965 | Cowell | 29/116.1 |
| 3,349,462 | 10/1967 | Mott | 29/116.1 |
| 3,380,138 | 4/1968 | Steichele | 29/116.1 |
| 3,412,228 | 11/1968 | Miyagi | 219/10.61 A |
| 3,529,116 | 9/1970 | Miyagi | 219/10.61 A |
| 3,600,550 | 8/1971 | Katsumata | 219/10.61 A X |
| 3,612,830 | 10/1971 | Dienes | 219/469 X |
| 3,619,539 | 11/1971 | Taylor | 219/10.61 A |
| 3,652,817 | 3/1972 | France | 219/10.61 A X |
| 3,689,967 | 9/1972 | Hurst | 29/116.1 |
| 3,701,873 | 10/1972 | Bauer et al. | 219/10.61 A |
| 3,879,594 | 4/1975 | Shillito | 219/10.492 |
| 4,402,233 | 9/1983 | Toivonen et al. | 29/116.1 X |

FOREIGN PATENT DOCUMENTS

| | | | |
|---|---|---|---|
| 1948525 | 4/1971 | Fed. Rep. of Germany | 219/10.492 |
| 7113902 | 7/1971 | Fed. Rep. of Germany . | |
| 0157354 | 12/1979 | Japan | 219/10.61 A |
| 0241688 | 10/1991 | Japan | 219/10.492 |
| 1302039 | 1/1973 | United Kingdom | 219/10.492 |

*Primary Examiner*—Timothy V. Eley
*Assistant Examiner*—C. Richard Martin
*Attorney, Agent, or Firm*—Bell, Seltzer, Park & Gibson

[57] ABSTRACT

A long godet having a shell mounted for rotation in a cantilevered arrangement and a shaft extending substantially coaxially within the shell for supporting an induction heater coil, forward and rearward portions of the shell being respectively journalled for rotation on forward and rearward portions of the shaft, the rear portion of the shaft being secured against rotational movement but free to move radially in at least one direction, whereby load induced deflections of the shell induce similar deflections in the shaft to maintain the radial spacing between the shell and the shaft mounted heating coil.

11 Claims, 1 Drawing Sheet

GODET

Figure 1:
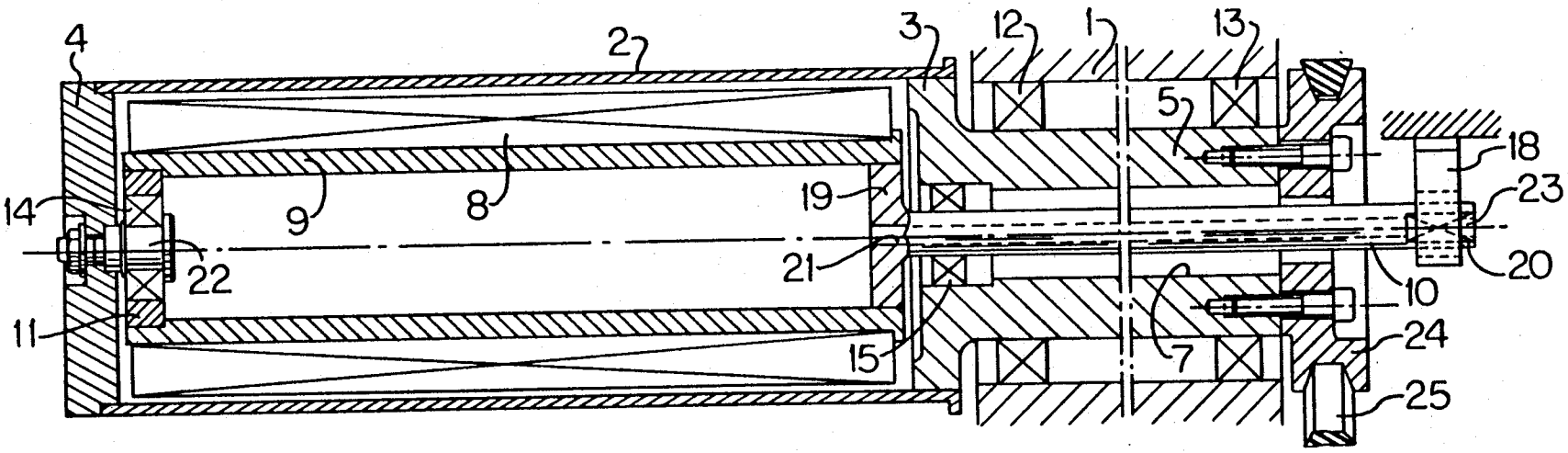

The invention in general relates to a godet of the kind useful in textile machinery, and, more particularly, to a dry induction heated godet of extended length.

Dry induction heated godets have found wide acceptance by the industry, not least because of their ability to provide uniform heat over their entire operational length. Because of the inevitable sagging of the shell, particularly of long godets, resulting from their cantilevered mounting or journalling, it has, however, proven difficult to control radial excursions or displacements of the free end of such godets. Such radial excursions may interfere with the proper operation of the godets in that the shell may move into contact with the primary induction coil mounted within the godet shell.

It is, therefore, an object of the invention to provide a godet constructed to prevent faulty operation due to contact between the godet shell and an induction heating coil mounted within the shell.

It is a more particular object of the invention to provide a long godet in which contact between the shell and primary heating coils provided therein is effectively avoided.

More particularly, it is an object of the invention to provide a godet of extended length in which contact between a sagging shell and the primary induction heating coil mounted inside the shell is effectively prevented.

It is yet another object of the invention to provide a long godet in which radial excursions of the godet shell during high speed rotation thereof do not result in contact with primary induction heating coils provided within the shell.

Other objects of the invention will in part be obvious and will in part appear hereinafter.

In a preferred embodiment of the invention these and other objects of the invention are accomplished by a long godet comprising a primary induction heating coil mounted on a stationary shaft within the godet shell, the forward end of the shaft being journalled in a bearing mounted in the face plate at the free end of the godet shell.

Preferably, the forward end of the heater support shaft journalled in the free end of the godet shell is radially movable relative to the axis of the rotary shell support shaft.

Furthermore, it may be advantageous to extend a rearward portion of the heater support shaft beyond its support bearing within the bore of the hollow shell support shaft into engagement with a locking arrangement to prevent the heater support shaft from rotating.

Another advantageous embodiment may result from extending the rear portion of the heater support shaft beyond its bearing within the bore of the shell support shaft and beyond the axial bore thereof into engagement with an arrangement for locking the heater support shaft against rotation, but permitting at least limited radial movement of the shaft.

Yet another advantageous embodiment may provide axially spaced self-aligning bearings for journalling the rear end portion of the heater support shaft within the hollow shell support shaft and to provide for elasticity in that portion of the heater support shaft located between the axially spaced bearings to permit flexing of the shaft between the bearing and, hence, limited radial movement of the forward portion of the heater support shaft.

Of course, by connecting the shaft supporting the primary induction heating coil to the free end of the godet, for instance, to a bearing provided in the forward face thereof, axial deflection of the heater support shaft cannot be prevented, because over the length of the godet the heater support shaft is no less subject to radial deflection than the godet is itself. However, by means of the bearing the gap between the primary induction heating coil and the godet shell will remain constant any sagging or rotary excursions of the shell not withstanding. In this manner contact between the primary heating coil and the godet shell is effectively avoided.

In a special embodiment of the invention the godet is structured in such a way that the heater support shaft is journalled in the hollow shell support shaft of the godet, and the godet is itself journalled in a stationary machine frame. In such a case, the forward end of the heater support shaft which may be journalled in a bearing in the face plate of the godet shell may preferably be radially movable relative to the rearward end of the heater support shaft, and while the latter may be secured against rotation it may nevertheless follow any radial deflections of the godet shell.

In accordance with one embodiment of the invention the end portion of the heater support shaft adjacent the machine frame may extend beyond the bearing by means of which the shaft is supported in the bore of the godet shell support shaft, the bearing being preferably a single bearing such as a self-aligning ball bearing or a roller bearing, permitting radial deflections of the journalled heater support shaft portion. The heater support shaft may be secured against rotary motion by any known means appropriately anchored at a location beyond the bore of the godet shell support shaft.

In a further embodiment, the rear end portion of the heater support shaft may extend beyond the rear end of the hollow godet shell shaft into engagement with locking means secured in the machine frame for preventing rotary motion of the heater support shaft. However, the locking means is preferably structured to permit at least limited radial movement of the heater support shaft.

In yet another embodiment of the invention the heater support shaft is journalled within the hollow shell support shaft in two bearings axially spaced from each other. The bearings are such that they permit radial deflections of the journalled heater support section which between the two bearings may additionally be provided with an intermediate weakened or flexible portion permitting radial deflections of the shaft.

Figure 3:
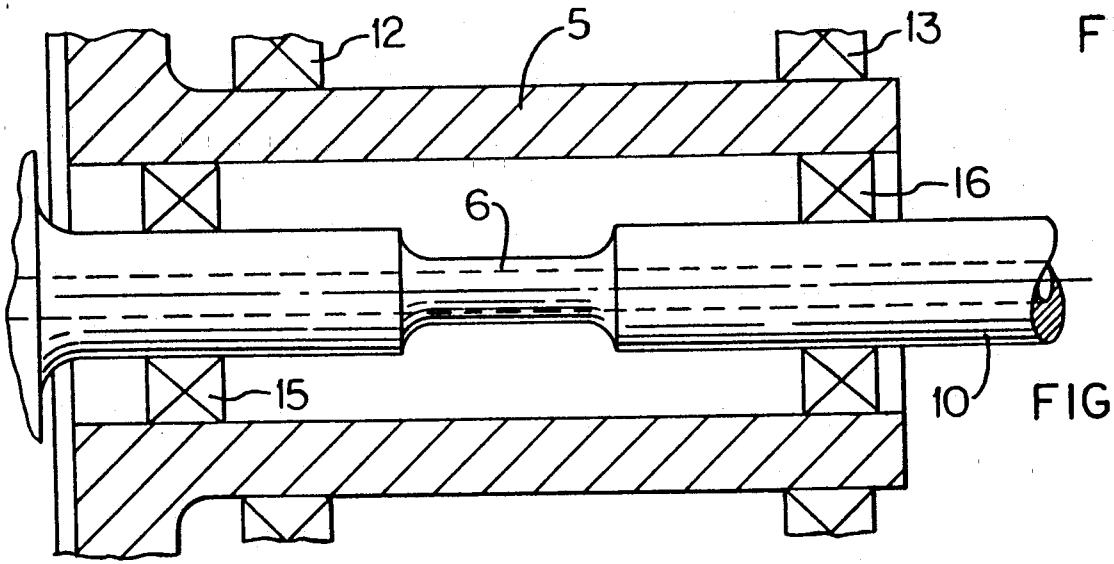
Figure 2:
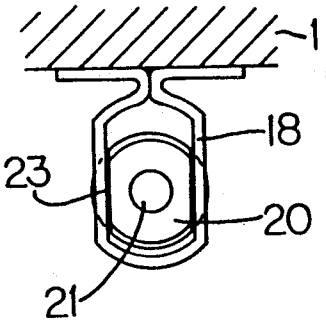

An advantageous embodiment of the invention will hereinafter be described with reference to the accompanying drawings, in which FIG. 1 is a longitudinal section of a godet structured in accordance with the teachings of the invention;

FIG. 2 is a cross-sectional view on an enlarged scale of the rearward portion of the heater support shaft including its locking arrangement as shown in FIG. 1; and FIG. 3 is a sectional view on an enlarged scale of an alternate embodiment of the rearward portion of the heater support shaft including a portion rendered flexible by a reduction in the diameter of the shaft.

FIG. 1 depicts in longitudinal section an inductively heated godet provided with a support shaft 5, a godet shell 2 secured to a flange 3 integral with the godet support shaft 5 and with a disc 4 for closing the forward end of the godet shell 2. The godet shaft 5 is seen to be provided with an axial bore 7 and is journalled for rotation by means of bearings 12 and 13 within a machine or support frame 1.

A shaft 9, 10 is arranged within the shell 2 of the godet. The shaft comprises a tubular portion 9 for supporting one or more primary induction heating coils 8 within the shell 2 of the godet and a portion 10 of lesser diameter than the coil supporting portion 9. The shaft portion 10 is seen to extend into and through the bore 7 of the shell support shaft 5 of the godet. Feed conduits for energizing the primary coil 8 may extend through an axial bore 21 in the shaft portion 10.

In the embodiment depicted in FIG. 1 the coil support portion 9 may be connected to the shaft portion 10 by means of a flange 19. The portion 10 of the shaft extending through the bore 7 of the shell support shaft 5 of the godet may protrude beyond the rear end of the shaft 5 into engagement with means 18 for locking the shaft 10 against rotation relative to the shell 2 of the godet.

In accordance with the invention and as shown in FIG. 1 the forward end of the coil support shaft portion 9 as well as the forward section of the shaft portion 10 are journalled within the godet. In accordance with FIG. 1 an axial bolt 22 is secured to the forward face plate 4 covering the free end of the shell 2, the bolt 22 serving to support a shaft bearing 14. A disc 11 received within the forward end of the coil support portion 9 serves to mount the bearing 14. Another bearing 15 is provided in a forward section of the bore 7 of shell support shaft 5 and serves to journal the shaft portion 10.

In accordance with the invention the forward portion of the composite heater support shaft 9, 10 may follow radial deflections or excursions to which the shell 2 of the godet may be subjected under stress. For this purpose, the bearing 15 on the rear shaft portion 10 may be a self-aligning bearing adapted to permit limited radial movement of the shaft 9, 10. The bearing 15 may be a self-aligning ball bearing or a roller bearing of the kind well known in the art. The rearward portion of the shaft 10 is seen to extend beyond the bearing 15 and through the bore 7 of the shaft 5 into engagement with means for securing the shaft 9, 10 against rotation.

As seen in FIG. 2 the locking arrangement 18 is such that while it prevents rotation of the shaft 9, 10 it does permit limited radial movement thereof. For this purpose, the end 20 of the shaft portion 10 may be provided with opposite flat portions 23 engaging flat surfaces of the locking means 18, the flat portions 23 being narrower than the adjacent surfaces to permit sliding movement therealong. The alignment of the flat shaft portions 23 with respect to the surface areas of the locking means 18 is such that the flat portions 23 may move upwardly or downwardly relative to the surfaces of the locking means 18, whenever the forward portion of the shaft 9, 10 is subjected to two opposite movements under loads acting on the shell 2 and transmitted to the shaft 9, 10, by way of the bearing 14. While in the schematically shown embodiment only movement parallel to the surfaces 23 is possible, this is not considered to be a disadvantage, because radial deflections of the shell 2 of the godet will as a rule primarily occur in the vertical direction, the godet having been designed for this purpose.

FIG. 3 shows an alternate embodiment of the invention. The forward end has not been shown as it may be substantially identical to the arrangement shown in FIG. 1. The embodiment of FIG. 3 differs from the one in FIG. 1 in that the rearward portion of the heater support shaft 10 is journalled in two bearings 15 and 16 mounted, respectively, at opposite ends of the bore 7 in the shell support shaft 5. The bearings 15 and 16 may preferably be self-aligning ball bearings or roller bearings. The shaft portion 10 is provided with a portion 6 of reduced diameter and increased flexibility. The portion 6 is positioned intermediate the bearings 15 and 16 and serves to absorb, by deflecting the shaft portion 10, radial forces acting on the forward portion of the godet.

Although not shown, it will be apparent to those skilled in the art that the rearward portion of the shaft 10 may be received in a locking means similar to the one shown in FIG. 1 to prevent rotary movement of the shaft 10. The locking means 18 shown in FIG. 1 and 2 and the flexible portion 6 of the shaft 10 have been shown by way of example only and may be replaced by any other structures providing equivalent functions. For example, the intermediate portion 6 providing increased flexibility to the shaft 10 may be replaced by means of the kind well known in the art of high speed centrifuges.

The godet herein described is of a kind having a length from between 400 mm to 1 600 mm (15.75" to 63") and preferably from about 1000 mm to about 1 300 mm (39.5" to 51") and may be useful in filament spinning equipment, ribbon extruders, and machinery for stretching industrial yarns, for instance, by simultaneously guiding a plurality of loops thereof over a plurality of such godets.

To impart rotary movement to the shaft 5 and the shell 10 connected thereto, a pulley 24 may be coaxially mounted on the shaft 5 at its end opposite the shell 2, and motion may be transmitted to the pulley 24 by means of a belt 25 leading to another pulley mounted on a drive shaft of an appropriate electrical motor, not shown. As will be apparent to persons skilled in the art, other driving arrangements may be possible as well.

The structure herein described effectively prevents contact between the shell 2 of the godet and the coil or coils 8 mounted on the shaft 9, since load induced radial deflections of the shell 2 are transmitted to the shaft 9 by way of the bearing 14 and cause the shaft 9 to be similarly deflected. The deflection will be absorbed by pivoting or flexing the rear portion 10 of the heater support shaft.

What is claimed is:

1. A godet comprising an elongate hollow cylindrical shell (2) having a free end and an opposite end portion, said opposite end portion including a tubular extension (5) which is adapted to be rotatably mounted to a machine frame member (1) so that the shell extends in cantilever fashion from the machine frame member to said free end of said shell, an elongate shaft (9) disposed coaxially within said shell and including a free end and an opposite end portion, said opposite end portion of said shaft comprising a shaft extension (10) which extends coaxially through said tubular extension (5), means (18) for securing said shaft extension (10) to the machine frame member (1) so as to preclude rotation of said shaft while permitting limited radial movement thereof, and bearing means (14) rotatably interconnecting the free end of said shell with the free end of said shaft, and so that load induced radial deflections of the shell are transmitted to the free end of said shaft and the shaft may be similarly deflected.

2. The godet as defined in claim 1 further comprising an induction heating coil (8) coaxially mounted upon said shaft (9), and so as to be radially spaced from said shell (2).

3. The godet as defined in claim 2 wherein said means (18) for securing said shaft extension (10) to the machine frame member comprises a pair of flat surfaces on opposite sides of said shaft extension, and a locking member which is adapted to be fixed to the machine frame member and having opposing flat surfaces which engage respective ones of said flat surfaces on said shaft extension.

4. The godet as defined in claim 1 further comprising second bearing means (15) interposed between said shaft extension (10) and the bore of said tubular extension (5) of said shell.

5. The godet as defined in claim 4 wherein said second bearing means (15) is positioned axially between said free end of said shaft (9) and said securing means (18), and comprises a self-aligning bearing.

6. The godet as defined in claim 1 further comprising a pulley (24) coaxially mounted to said tubular extension (5) so that the cylindrical shell (2) may be rotatably driven.

7. A godet comprising an elongate hollow cylindrical shell (2) having a free end and an opposite end portion, said opposite end portion including a tubular extension (5) which is adapted to be rotatably mounted to a machine frame member (1) so that the shell extends in cantilever fashion from the machine frame member to said free end of said shell, an elongate shaft (9) disposed coaxially within said shell and including a free end and an opposite end portion, said opposite end portion of said shaft comprising a shaft extension (10) which extends coaxially through said tubular extension (5), means (18) for securing said shaft extension (10) to the machine frame member (1) so as to preclude rotation of said shaft, first bearing means (14) rotatably interconnecting the free end of said shell with the free end of said shaft, second bearing means (15, 16) interposed between said shaft extension (10) ad the bore of said tubular extension (5) of said shell, and said shaft extension comprising a segment (6) of increased flexibility so that load induced radial deflections of the shell are transmitted to the free end of said shaft by said first bearing means (14) and the shaft may be similarly deflected.

8. The godet as defined in claim 7 wherein said second bearing means comprises first and second axially spaced apart rotary bearings, and wherein said segment of increased flexibility is positioned axially between said first and second rotary bearings.

9. The godet as defined in claim 8 wherein said first and second rotary bearings each comprise a self-aligning ball bearing.

10. The godet as defined in claim 8 wherein said first and second rotary bearings each comprise a self-aligning roller bearing.

11. The godet as defined in claim 8 further comprising an induction heating coil (8) coaxially mounted upon said shaft (9) so as to be radially spaced from said shell (2) by a predetermined spacing.

* * * * *